United States Patent [19]

Natho et al.

[11] Patent Number: 5,004,091

[45] Date of Patent: Apr. 2, 1991

[54] COMPRESSION-MOLDED CARRYING CASE

[75] Inventors: Bradford J. Natho, Taunton; George L. Andrade, South Dartmouth; John M. Wheaton, North Dartmouth, all of Mass.; Wayne I. Schmitt, Coventry, R.I.

[73] Assignee: American Tourister, Inc., Warren, R.I.

[21] Appl. No.: 509,208

[22] Filed: Apr. 16, 1990

[51] Int. Cl.[5] ..... A45C 3/00; A45C 13/00

[52] U.S. Cl. ..... 190/18 R; 190/40; 190/125; 150/129

[58] Field of Search ..... 190/124, 125, 127, 115, 190/18 R, 40, 119; 150/127, 129; 428/193, 309.9, 310.5; 383/116

[56] References Cited

U.S. PATENT DOCUMENTS

| | | | |
|---|---|---|---|
| 2,950,793 | 8/1960 | Axtell | 190/115 |
| 3,067,451 | 12/1962 | Levin et al. | 190/18 A X |
| 3,185,271 | 5/1965 | Kotkins | 190/18 R X |
| 3,544,418 | 12/1970 | Holtzman | 190/125 X |
| 3,710,901 | 1/1973 | Guard et al. | 190/107 |
| 3,942,225 | 3/1976 | Kramer | 190/18 R X |
| 3,948,436 | 4/1976 | Bambara | 383/116 X |
| 4,325,469 | 4/1982 | Gurian | 190/125 X |
| 4,596,395 | 6/1986 | Conti | 190/18 A X |
| 4,671,393 | 6/1987 | Rainey | 190/125 X |
| 4,703,519 | 10/1987 | Krenzel | 190/119 X |

FOREIGN PATENT DOCUMENTS

| | | | |
|---|---|---|---|
| 305207 | 3/1989 | European Pat. Off. | 190/115 |
| 2827199 | 1/1980 | Fed. Rep. of Germany | 190/40 |
| 147812 | 4/1981 | Fed. Rep. of Germany | 383/116 |
| 2508288 | 12/1982 | France | 190/125 |
| 2550768 | 2/1985 | France | 383/116 |
| 1376198 | 12/1974 | United Kingdom | 190/124 |

*Primary Examiner*—Sue A. Weaver

*Attorney, Agent, or Firm*—Wood, Herron & Evans

[57] ABSTRACT

A carrying case has a box and a lid. The box and lid are both compression-molded from a laminate of fabric-foam-fabric. The lid is hinged to the box along one edge. A slide fastener interconnects the remaining free edges of the box and lid to close the lid to the box.

2 Claims, 6 Drawing Sheets

COMPRESSION-MOLDED CARRYING CASE

BACKGROUND OF THE INVENTION

This invention relates to a carrying case for an article such as a television camera, the article requiring protection against impact as it is carried from place to place.

Carrying cases have been made from hard-sided shells, the shells having compression-molded foam liners. The liners conform generally to the shape of the contained article to keep it from shifting from within the case.

Soft-sided luggage was introduced some years ago and has become quite popular, being regarded as more desirable than hard-sided luggage because of its look and feel. Soft-sided luggage, however, has not been employed for carrying cases for articles needing impact protection even though it is aesthetically more desirable. The soft sides do not provide the protection that is necessary to maintain the articles free from damage.

SUMMARY OF THE INVENTION

An objective of the present invention has been to provide a carrying case having the appearance and feel of quality soft-sided luggage and which provides the protection of the type heretofore only provided by hard-sided luggage.

This objective is obtained by forming a sandwich or laminate of fabric, foam slab, and fabric. The laminate is compression-molded to form two major parts of the carrying case, e.g., the box and the lid. The lid is hinged to the box. A slide fastener joins the free edges of the lid to the box in order to close the lid upon the box.

In one embodiment of the invention, the lid and box are substantially identical and may differ from one another only in the exterior pattern molded into the surface of the respective shells.

In another embodiment of the invention, the box is initially formed as a rather shallow shell. A molded rim is stitched around the free edges of the shell to complete the formation of the box. A handle is stitched to the rim. The slide fastener elements are stitched respectively to the free edge of the rim and the adjoining free edge of the lid, the lid being hinged to the rim.

Still another embodiment of the invention is a deep drawn box and a shallow lid with the lid being hinged to the box and having a slide fastener to join the free edges of the lid to the box to close it.

In any of the embodiments, it can be seen that the article can be held very snugly. For example, the interior dimensions of the carrying case can be just slightly less than the exterior dimensions of the article to be carried so that the foam is slightly compressed or stressed when the zipper is closed around the article. There is, therefore, no need to provide an interior for the carrying case that is molded to conform to the outline of the article to be carried.

The appearance of the carrying case is enhanced by using thermoformable knit fabrics to form the laminate. The knit fabrics stretch during the molding-thermoforming process and retain the case configuration as well as designs molded into the surface of the laminate during the compression-molding step. Thus, the use of the knit fabrics is particularly advantageous in molding unique patterns or impressions into the interior or exterior of the carrying case in order to present a neat customized appearance.

Another feature of the invention is the unique bumper foot. Each bumper foot has two holes. A plate has serrated posts projecting from it, the posts being alignable with the holes in the bumper foot. The posts project into the holes in the bumper foot and clamp the bottom wall of the carrying case between the plate and foot. This bumper foot feature of the invention eliminates rivets and holes in the exterior surface of the bumper foot and reduces the overall assembly time.

BRIEF DESCRIPTION OF THE DRAWINGS

The objectives and the features of the present invention will become more readily apparent from the following detailed description taken in conjunction with the accompanying drawings in which.

DETAILED DESCRIPTION OF THE INVENTION

Figure 1:
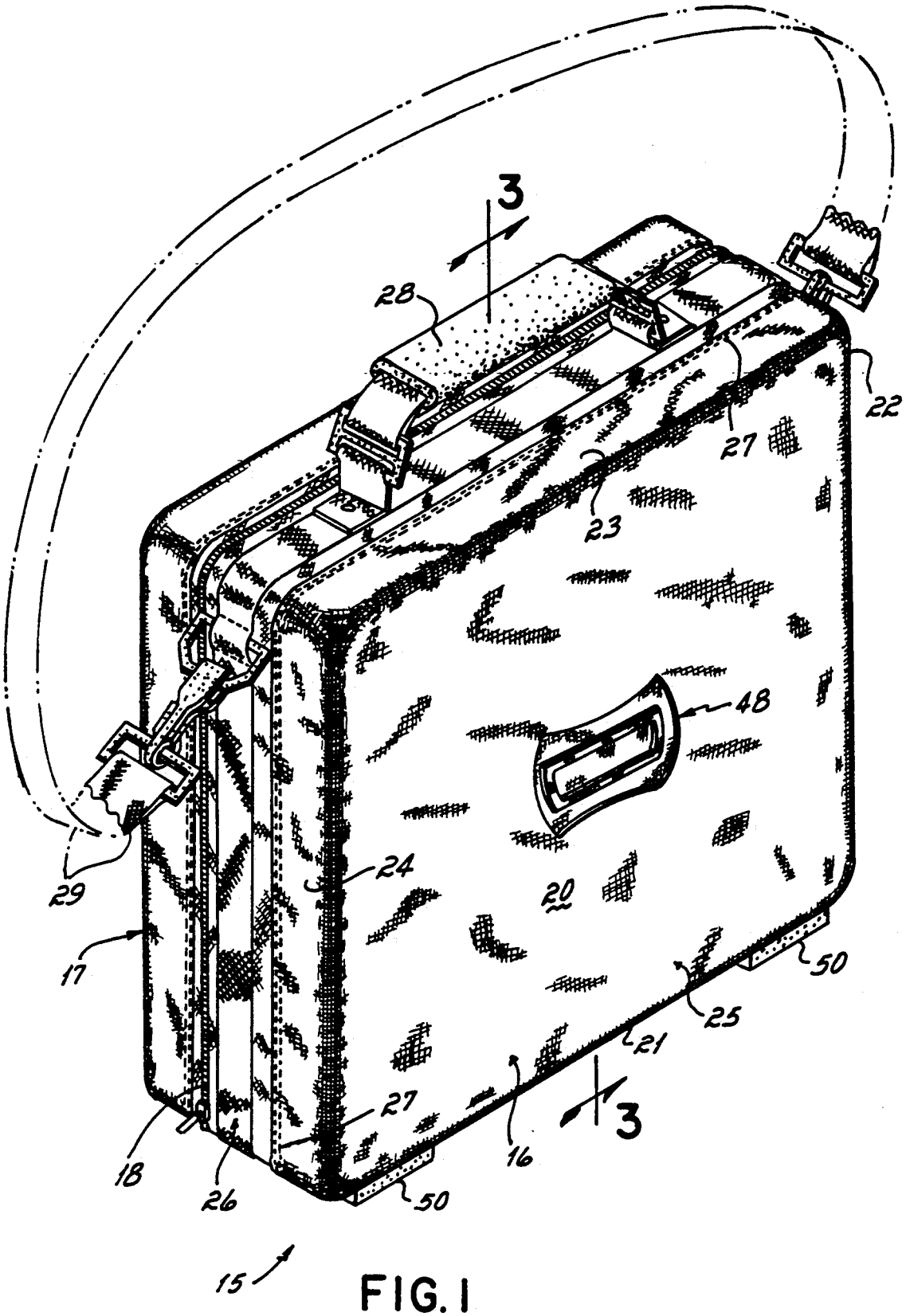
FIG. 1 is a perspective view of the carrying case of the present invention.
Figure 2:
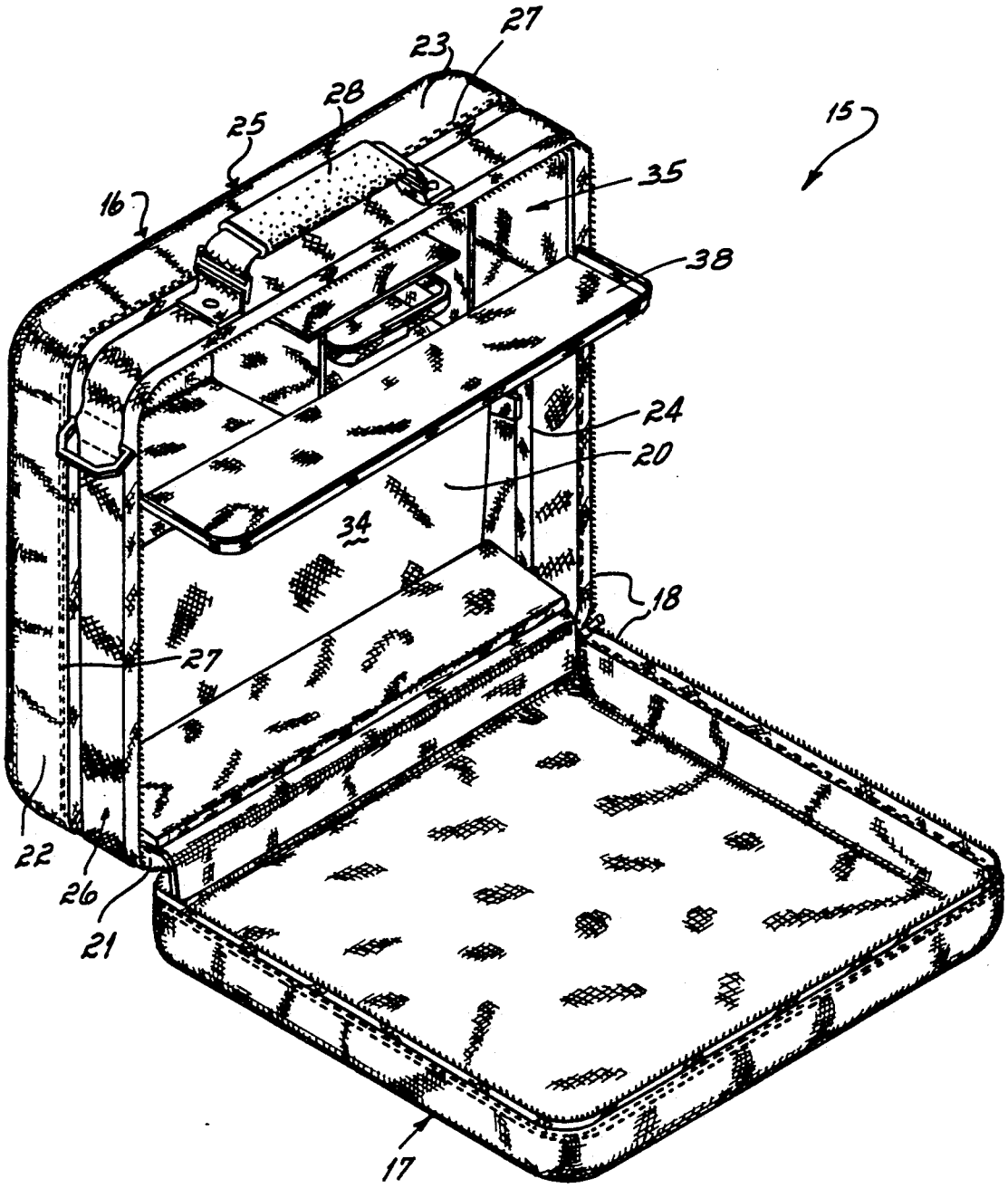
FIG. 2 is a perspective view of the carrying case with the lid open to show the interior of the case.
Figure 3:
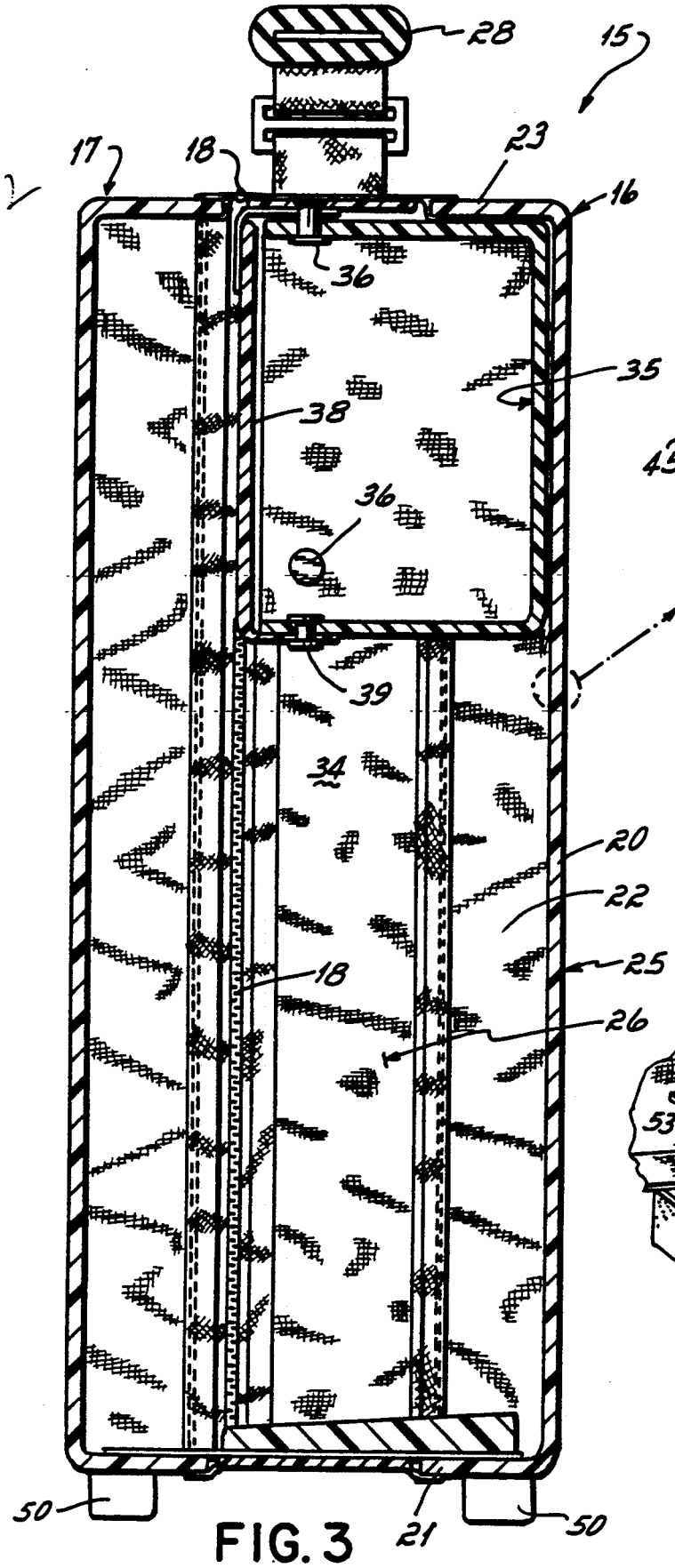
FIG. 3 is a cross-sectional view taken along lines 3—3 of FIG. 1.

A carrying case 15 is shown in FIGS. 1–3. The carrying case has a box 16 and a lid 17. The lid is hinged to the box (FIG. 2) and the lid can be joined to the box by a slide fastener or zipper 18.

The box 16 has a major wall 20 and four side walls 21, 22, 23 and 24.

The lid is a compression-molded shell formed from a laminate of fabric-foam-fabric. The box has one section 25 formed as a compression-molded shell from a laminate similar to the lid. A gusset or rim 26 formed of a similar fabric-foam-fabric laminate is stitched along a line 27 to the free edge of the shell 25 to form the box. A handle 28 and a carrying strap 29 are mounted on the rim 26, the rim 26 being in the center of the carrying case. The slide fastener 18 is stitched around the free edges of the lid 17 and rim, respectively.

Within the interior 34 of the carrying case is an accessory box 35. The accessory box is also formed from a compression-molded laminate of fabric-foam-fabric. As can be seen, particularly from FIG. 3, the accessory box requires a very deep draw. It is attached to the carrying case by a rivet 36 connection to three walls of the molded rim 26. A lid 38 for the accessory box is attached to the accessory box by rivets 39.

Figure 3A:
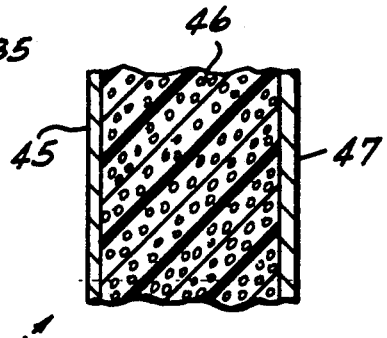
FIG. 3A is an enlarged cross-sectional view of the encircled area of FIG. 3.

As seen in FIG. 3A, the shell and lid are preferably formed of a 70 denier interior fabric 45 laminated to a one-quarter inch, six pound foam 46. The exterior 47 is formed by a 150 denier fabric laminated to the foam core 46. The rim 26 is formed of similar materials except that the foam core is one-eighth inch thick.

The foam core is crosslink polyethylene, polyurethane foam, ethylene vinyl acetate foam, or combinations thereof, such as 70% crosslink polyethylene and 30% ethylene vinyl acetate (EVA). The fabrics are preferably a knit polyester. Nylons and rayons can be used. Woven fabrics can also be used but they do not produce the rib definition or design definition embossed into the exterior of the shells as shown, for example, at 48 in FIG. 1.

Figure 3B:
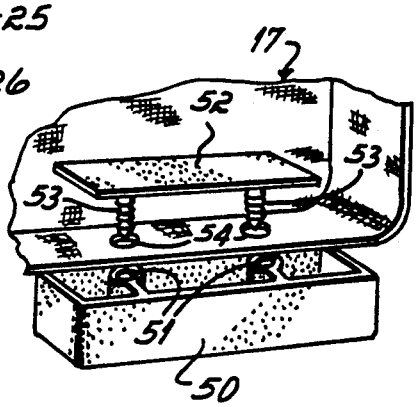
FIG. 3B is a slightly disassembled perspective view of the bumper foot assembly.
Figure 4:
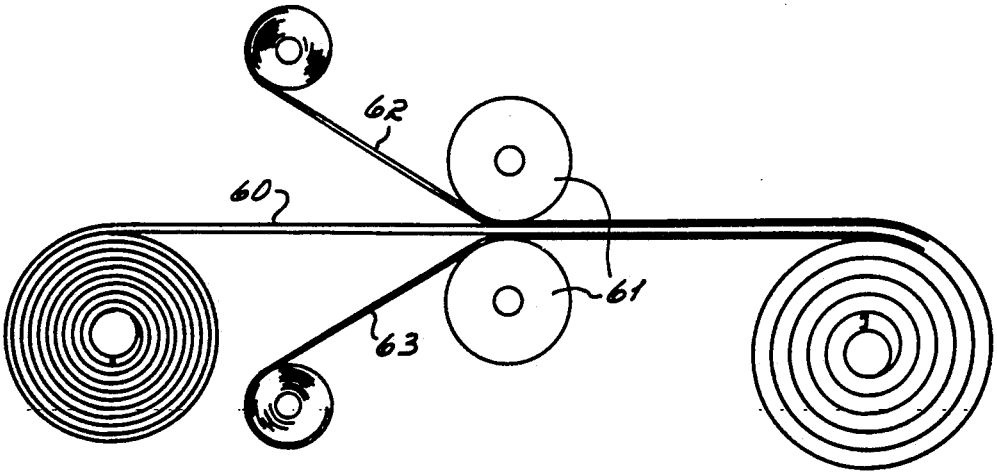
FIGS. 4–9 are diagrammatic views of the process steps in forming the carrying case, 7A and 9A, respectively, being an enlarged view of the encircled area of 7, and 9A being a cross-section of 9.

A bumper foot mount is shown in FIG. 3B. The bumper foot 50 has two holes 51 that face the shell such as the lid shell 17. A plate 52 has serrated posts 53 projecting from it in alignment with the holes 51. The shell has holes 54 through which those posts pass.

In assembly, the posts 53 are aligned with the holes 51 in the bumper foot and the plate is squeezed toward the bumper 50. The serrated posts engage the relatively soft material of the bumper foot and the serrations in the posts bury themselves into the soft bumper foot material. Preferably the plate an posts are formed of Nylon the bumper foot formed of a plastic.

The shells, the rim and the accessory box are formed by the process steps generally as depicted in FIGS. 4–9. A web of foam 60 is, for example, one-quarter inch thick, six pound crosslink polyethylene. It is laminated between lamination rollers 61 to an exterior fabric 62 and interior fabric 63. Preferably, the exterior fabric is a 150 denier polyester knit and the interior fabric is a 70 denier polyester knit.

Figure 5:
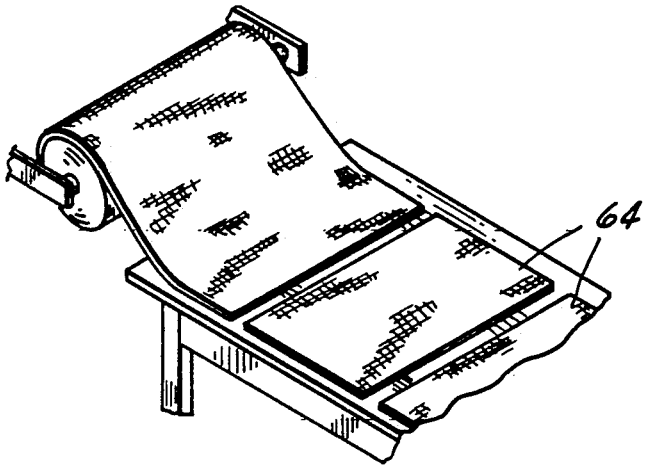
Figure 6:
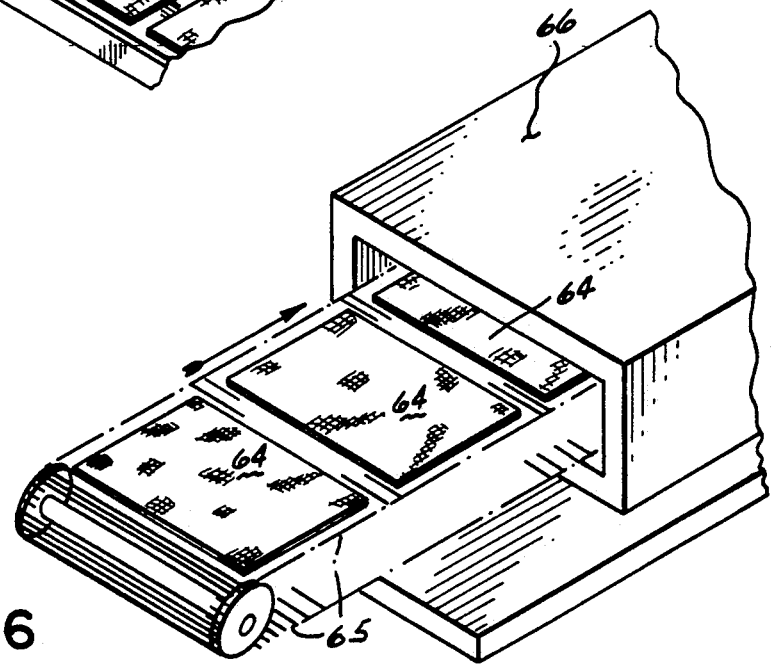
Figure 7:
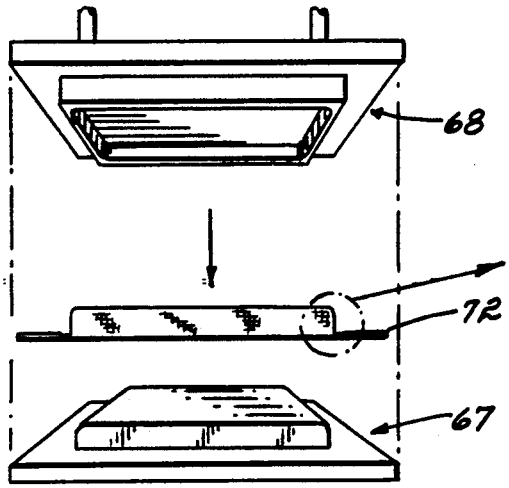
Figure 7A:
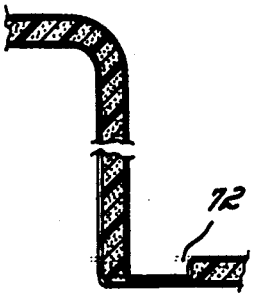
Figure 8:
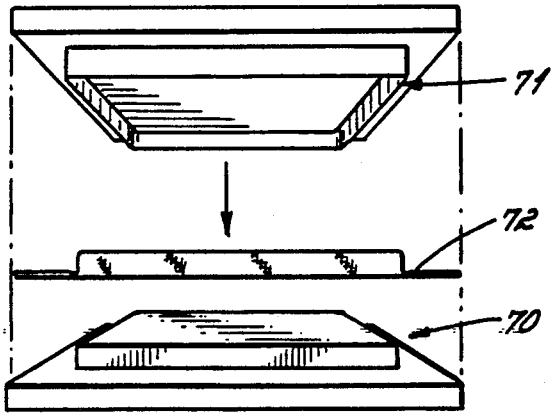

As shown in FIG. 5, the laminated material is cut to rough blank size producing blanks 64.

The blanks are mounted on an endless conveyor screen 65 and conveyed through a heat tunnel 66. The blanks are raised to a thermoforming temperature and are then placed between matched male 67 and female 68 molds. The molds come together on the blank and mold the shell to the desired shape.

Figure 9:
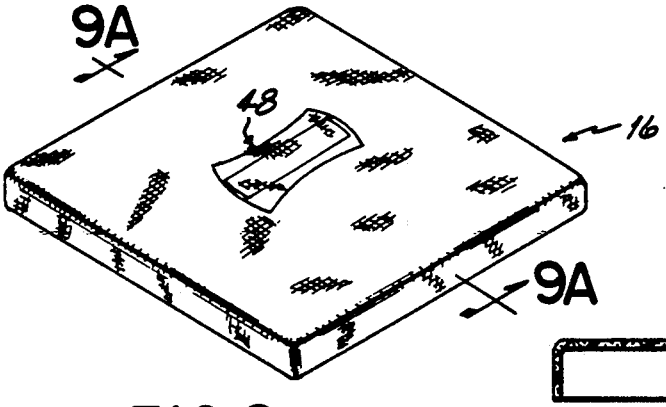
Figure 9A:
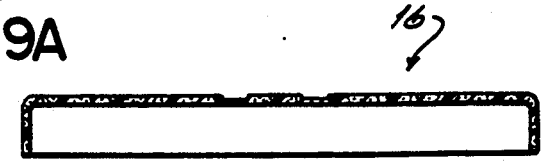

The molded shell is then in a cutting die consisting of a die plug 70 and a perimeter die 71. These dies are brought together with the molded shell therebetween and the flash 72 is cut off. The finished shell is as shown in FIGS. 9 and 9A.

One of the shells has the rim 26 stitched to it. The other shell, forming the lid, is hinged to the rim and a slide fastener or zipper is stitched to the rim and edge of the shell for joining the lid shell 17 to the rim.

Figure 10:
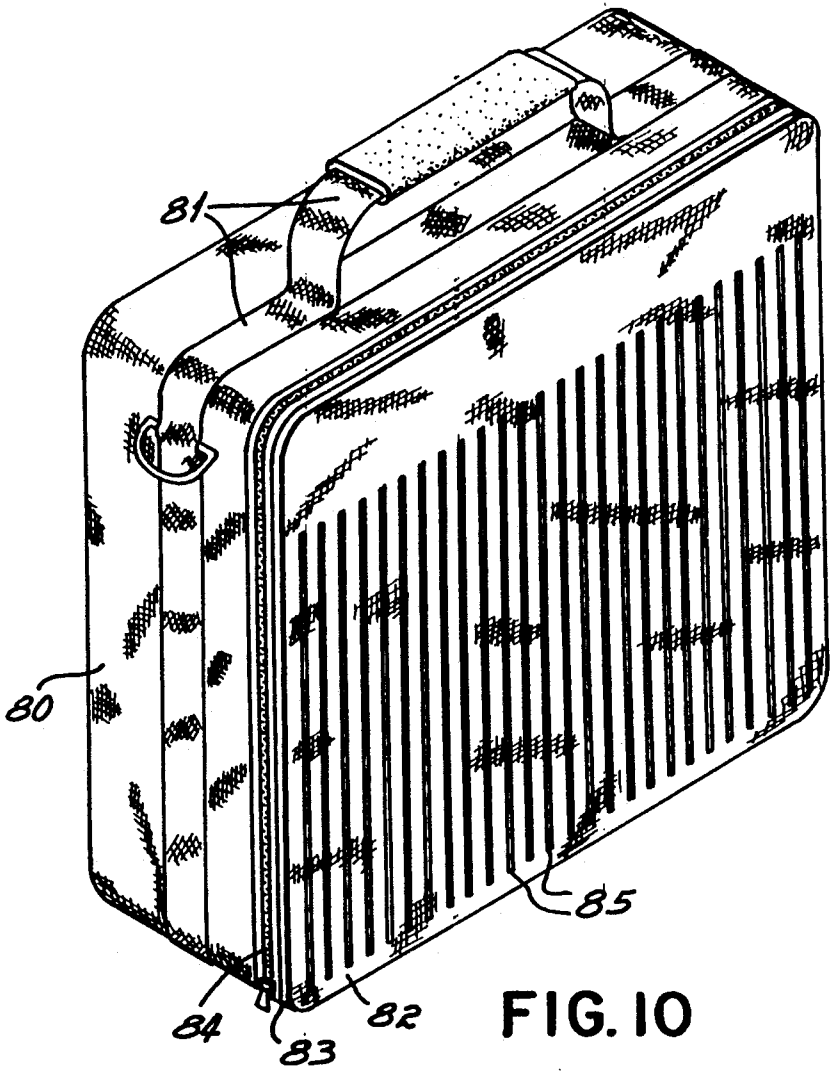
FIG. 10 is a perspective view of an alternative form of the case.

An alternative form of the invention is shown in FIG. 10. There, the box 80 is a deep drawn shell to which the carrying strap and handle 81 are stitched. A very shallow lid 82 is hinged at 83 to the box, by stitching, and a slide fastener 84 is stitched to the free edges of the lid and shell, respectively, to close the lid upon the shell. Note the rib design 85 which is best formed when the exterior fabric is a polyester knit.

Figure 11:
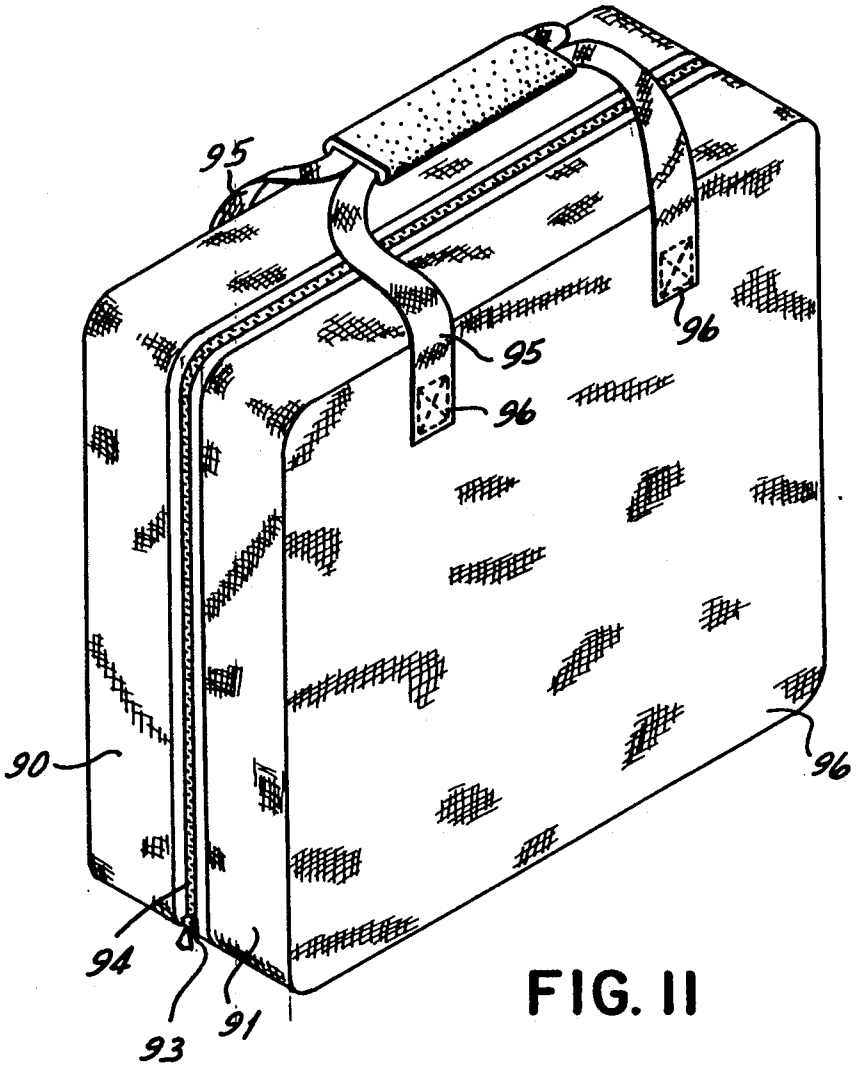
FIG. 11 is a perspective view of still another alternative form of the carrying case.

Still another embodiment is shown in FIG. 11. There, both shells 90 and 91 are of substantially equal dimension. The shells are hinged together along one edge 93. A slide fastener 94 is stitched to the opposed free edges of the respective shells to close the carrying case. Since the carrying case is divided along the center, it is not possible to provide the same type of centrally-mounted handle and carrying strap as depicted in the earlier embodiments. However, a pair of handle straps 95 may be employed for carrying the case. The handle straps are stitched as at 96 to the respective shell.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. A carrying case comprising, two dish-shaped shells having four sides, said shells being formed of a compression-molded fabric-foam-fabric laminate, each said shell having a rectangular major wall and a perpendicular wall extending around the perimeter of said major wall, means hinging said shells together along one side of each of said rectangular shells, cooperating zippers stitched to the remaining three opposed edges of said shells, a plurality of bumper feet mounted on an exterior side of said shell, each bumper foot having two holes opening onto said shell, a plate mounted on the interior of said shell opposite each foot, two serrated posts projecting from said plate and projecting into said foot holes to secure said plate to said foot with said shell side sandwiched therebetween.

2. A bumper foot mounting for a carrying case comprising, a soft bumper foot having at least two holes, a clamping plate, at least two serrated posts projecting from said clamping plate and projecting into said bumper foot holes.

* * * * *